United States Patent [19]

Lagally

[11] Patent Number: 4,653,576

[45] Date of Patent: Mar. 31, 1987

[54] EXPANDABLE ANTIVIBRATION BAR FOR A STEAM GENERATOR

[75] Inventor: Hermann O. Lagally, Hempfield Twp., Westmoreland County, Pa.

[73] Assignee: Westinghouse Electric Corp., Pittsburgh, Pa.

[21] Appl. No.: 729,385

[22] Filed: May 1, 1985

[51] Int. Cl.[4] ..... F28F 9/00

[52] U.S. Cl. ..... 165/69; 165/162

[58] Field of Search ..... 165/69, 162

[56] References Cited

U.S. PATENT DOCUMENTS

| | | | |
|---|---|---|---|
| 1,928,009 | 9/1933 | Dornier . | |
| 3,007,679 | 11/1961 | Byerley et al. | 257/239 |
| 3,199,582 | 8/1965 | Vogt et al. | 165/69 |
| 3,212,567 | 10/1965 | Romanos | 165/69 |
| 3,292,691 | 12/1966 | Welter et al. | 165/162 |
| 3,360,039 | 12/1967 | Frei | 165/172 |
| 3,545,537 | 12/1970 | Hill, Jr. | 165/162 |
| 3,637,008 | 1/1972 | Michel et al. | 165/69 |
| 3,864,811 | 2/1975 | Walker . | |
| 4,204,570 | 5/1980 | Eisinger . | |
| 4,208,988 | 6/1980 | Jacobs et al. . | |
| 4,577,386 | 3/1986 | Faudou et al. . | |

FOREIGN PATENT DOCUMENTS

| | | | |
|---|---|---|---|
| 2200462 | 4/1973 | France . | |
| 685848 | 1/1953 | United Kingdom . | |
| 813152 | 5/1959 | United Kingdom . | |
| 956129 | 4/1964 | United Kingdom . | |
| 1188564 | 4/1970 | United Kingdom . | |
| 1404643 | 9/1975 | United Kingdom | 165/162 |
| 1532100 | 11/1978 | United Kingdom . | |

OTHER PUBLICATIONS

European Search Report EP 85 30 8234.

*Primary Examiner*—Allen M. Ostrager
*Attorney, Agent, or Firm*—L. A. DePaul

[57] ABSTRACT

A steam generator for use with a nuclear power plant is provided with expandable antivibration bars. The antivibration bars are positioned between columns of tubes in the steam generator and are attached to retaining rings surrounding the bundle of tubes. The antivibration bars are provided with upper and lower bars having mating surfaces comprising series connected inclined planes which allow for relative motion between the upper and lower bars and provide a means to increase the overall thickness across the two bars. Take-up means are provided to guide and assure proper relative motion. The antivibration bars are divided into two elongated lengths each of which forms one of the legs of the "U" shape which the antivibration bar assumes at installation. A double pivot is provided at the connection between the two legs to allow side-by-side positioning of the legs which facilitates installation into an already built steam generator.

13 Claims, 7 Drawing Figures

EXPANDABLE ANTIVIBRATION BAR FOR A STEAM GENERATOR

CROSS REFERENCE TO RELATED APPLICATIONS

This invention is related to patent applications entitled "Compliant Antivibration Bar for a Steam Generator" by H. 0. Lagally, et al, and "Antivibration Bar Installation Apparatus" by H. 0. Lagally and J. H. Stevens, both of which are assigned to the Westinghouse Electric Corporation and both of which are being simultaneously filed herewith.

BACKGROUND OF THE INVENTION

1. Field of the Invention

This invention relates in general to the field of steam generators for commercial nuclear power plants and in particular to apparatus for preventing vibration of the tubes of steam generators and more particularly to apparatus for eliminating clearance space between the tubes of a steam generator and the antivibration bars disposed between the columns of the tubes and thereby eliminating the vibration of said tubes during operation of the steam generator.

2. Description of the Prior Art

Nuclear power plants have been safely producing electricity for many years. The principal of operation of such commercial nuclear power plants is well known. A nuclear core containing fissionable fuel is caused to achieve criticality and thereby produces heat. The heat is removed by a reactor coolant, which in the field of pressurized water reactors, comprises water. The water reactor coolant also serves as a nuclear moderator which thermalizes fast neutrons in order to enhance the probability of the neutrons producing additional nuclear fissions and thereby sustaining the nuclear reaction. Since the chain reaction is dependent upon the presence of the nuclear moderator, the absence of the same stops the chain reaction and shuts down the reactor. This is only one of the inherent safety features of a water-cooled nuclear reactor which contributes to the overall high safety factor of such reactors.

The heat produced by the nuclear core is transferred to the reactor coolant as it passes through the nuclear core. The reactor coolant subsequently transfers the heat it has received to another medium, which also comprises water and which is transformed into steam. The steam is then used to generate electricity by conventional steam turbine-electrical generator apparatus.

The reactor coolant transfers its heat to the secondary medium in steam generators specifically designed for the nuclear power field. The design of such nuclear steam generator is well known in the art In general, the steam generator design comprises a plurality of small diameter tubes which are housed within a pressure-bearing container in such a manner as to allow and promote the transfer of heat to produce steam.

In particular, the design of the nuclear steam generators includes an outer shell comprising an elongated cylinder having rounded ends attached thereto. A large number of U-shaped tubes oriented along the longitudinal axis of the cylinder, are disposed in the lower cylindrically-shaped portion of the steam generator. The lower portion has a lower or bottom end thereof associated with a channel head typically of a hemispherical configuration. The channel head is divided by a partition into a first half typically known as the hot leg, and a second half typically known as the cold leg. The high temperature reactor coolant from the nuclear reactor is input into the steam generator through a primary coolant inlet nozzle into the hot leg. The reactor coolant then flows from the hot leg into the exposed openings of the plurality of U-shaped tubes,through the tubes and then through the cold leg portion of the channel head. Finally, the reactor coolant exits from the steam generator through a primary coolant outlet nozzle.

The portion of the steam generator primarily including the bundle of U-shaped tubes and the channel head is typically referred to as the evaporator section. The steam generator further includes a steam drum section which is located at the upper end of the cylindrical shell of the steam generator. Moisture separators are located within the steam drum section. Feedwater enters the steam generator through an inlet nozzle which is disposed in the upper portion of the cylindrical shell. The feedwater is distributed and mixed with water removed by the moisture separation and then flows down an annular channel surrounding the tube bundle. The feedwater then reverses direction and passes up around the outside of the tubes of the tube bundle where it absorbs heat from the reactor coolant flowing within the tubes. The heat absorbed causes the feedwater to boil and produce steam. The steam produced by the boiling water rises into the steam drum section. The moisture separator then removes the water entrained within the steam before it exits from the steam generator through a steam outlet. The steam then flows to the steam turbine which is connected to an electrical generator. Subsequently the steam from the steam turbine is condensed and rerouted into the steam generator to continue the flow cycle.

The U-shaped tubes are supported at their open ends by conventional means whereby the ends of the tubes are seal welded to a tube sheet which is disposed transverse to the longitudinal axis of the steam generator. A series of tube supports arranged in spaced relationship to each other are provided along the straight portion of the tubes in order to support such portion of the tubes. An upper tube support assembly is utilized to support the U portion of the tubes of the tube bundle. The upper support assembly comprises a plurality of retainer rings arranged around the outside of the tube bundle in spaced relationship to each other.

The retaining rings, like the tube supports, are arranged substantially transverse to the longitudinal axis of the steam generator. Each retaining ring is generally of an oval shape which coincides with the outer periphery of the tube bundle at the particular location of the retaining ring. Thus, the size of the oval of the retaining rings decreases with the distance toward the end of the tube bundle. The uppermost retaining ring, therefore, is of relatively small circular diameter inasmuch as it is located at the uppermost portion of the tube bundle where the shape of the tube bundle is rapidly converging.

Each of the retaining rings is connected to a plurality of antivibration bars which are typically disposed between each column of the U-shaped tubes. The vibration bars in the prior art comprise a bar bent into a V-shaped configuration such that two legs are formed with an angle therebetween. The V-shaped members are inserted between successive columns of the steam generator flow tubes. The V ends of the members are inserted between the flow tubes; the free ends of the V members are welded to opposite sides of the appropriate retainer ring. In this manner, each of the tubes of the tube bundle are supported along the length of the curved or U-shaped portion at a number of spaced locations by an antivibration bar. This arrangement provides local tube support and yet allows the feedwater to flow around and between the curved portion of the steam generator tubes. In other words, the antivibration bars provide support and do not substantially interfere with the flow of the feedwater.

The antivibration bars are intended to prevent vibrations of the individual tubes of the entire tube bundle. It is well known that the vibrations in question are caused by flow of the water and steam past the flow tubes. These flow-induced vibrations can potentially damage the flow tubes. It is also well known that the U-shaped portion of the tube bundle is most severely affected by the vibrations. And, because of the bent configuration, the most difficult to adequately support in order to eliminate the flow-induced vibrations. Further, it is well accepted that current hydraulic technology cannot exactly define nor eliminate the root cause of the vibrations. It has been, therefore, left to mechanical means to attempt to completely or at least substantially eliminate the vibration problem. While the advent of the antivibration bars or similar technology has materially reduced the magnitude and presence of vibration, they have not completely eliminated the vibrations.

The mechanical aspects of the curved or bent portion of the tubes of the tube bundle are the major obstacles in the way of a mechanical solution to the problem.

The U-shaped tubes of the tube bundle have dimensional tolerances associated with their outer diameter. There are also variations caused by ovalization of the tubes as a result of the bending. Furthermore, the spatial relationship between adjacent tubes is a variable, albeit within set design limits. Thus, there is a demensional tolerance associated with the nominal spacing between the steam generator tubes. There is also a dimensional tolerance associated with the outer dimensions of the prior art vibration bars, which as explained above, typically comprise round tubes. They may also comprise a square, an oval, or any other shape having a uniform, a nonuniform cross-sectional shape. However, notwithstanding the particular shape chosen, there is the dimensional tolerance associated with the size of the bars. The combination of these tolerances and dimensional variances prevents the elimination of gaps between the antivibration bars and the tubes of the steam generator. Any gaps are, of course, very undesirable because they allow vibration of the tubes and relative motion between the tubes and the antivibration bars. The relative motion can cause wear and subsequent failure of the tubes of the steam generator. There have been numerous attempts in the prior art to minimize the gaps. Unfortunately, decreasing the size of the gaps only decreases the magnitude of the problem, it does not eliminate the problem.

In U.S. Pat. application Ser. No. 670,728, filed Nov. 13, 1984, by B. C. Gowda, et al, and assigned to the Westinghouse Electric Corporation, a novel approach is disclosed to eliminate gaps between the steam generator tubes and the antivibration bars. That application provided a method whereby hollow antivibration bars are expanded in place between the columns of steam generator tubes to eliminate the gaps due to dimensional variations. While such method is obviously a step in the right direction, it does have its limitations. Such method is difficult to use with previously operated steam generators which may be or are radioactive and where it is required to perform the installation under water with remotely-operated tools and where the spacing between adjacent tubes is further variable due to a buildup of deposits due to steam generator operation. With this method of expansion, it is also difficult to control the expansion in order to obtain final controlled clearances. There is, then, the need for other means and apparatus to prevent vibration of the steam generator tubes and the relative motion between the antivibration bars and the steam generator tubes.

Copending patent application, filed simultaneously herewith, entitled "Complaint Antivibration Bar for Steam Generators" by H. 0. Lagally, et al, is another approach to eliminate the gaps which exist between the prior art antivibrator bars and the steam generator flow tubes. In that application, the flexibility of the supporting plates of the antivibration bars accommodate the variations in actual distance between the columns of flow tubes.

Notwithstanding the most recent advancements in art of antivibration bars, there is always the need and the desire to provide even further new and different advances in this art. Then too, the differences between a steam generator being newly built and a steam generator which has been in service for an appreciable period of time are such that one type of antivibration bar may not be advantageously used.

Accordingly, an object of the present invention is to provide new and different apparatus to prevent operational vibrations of the flow tubes of a steam generator.

Another object of the prevent invention is to provide antivibration bar apparatus which eliminates gaps between the antivibration bars and the tubes of a steam generator.

Another object of the present invention is to provide antivibration bar apparatus which is capable of being installed in a steam generator which has been previously operated and may, therefore, include mineral deposits on the tubes of the steam generator.

Another object of the present invention is to provide antivibration bar apparatus which is capable of being installed in a steam generator which has previously been operated, and may, therefore, be radioactive.

Another object of the present invention is to provide antivibration bar apparatus which is capable of being installed in a completely and previously built steam generator.

SUMMARY OF THE INVENTION

The above specifically expressed objects, as well as those implied but not expressed, based upon a fair reading and interpretation of the specification, claims and drawings, are achieved by the present invention which comprises an expandable support between successive columns of steam generator tubes in the portion of the steam generator where the flow tubes are bent into a U-shaped configuration.

The expandable support comprises antivibration bars which are split along the plane of the columns of tubes and are provided with one or more sets of mating inclined planes at the split surfaces. The split halves allow relative motion between the halves of the antivibration bars, while the inclined planes provide a means to increase or decrease the overall thickness of the antivibration bars. In this manner, the space between columns of steam generator tubes may be fitted with antivibration bars whose thickness coincides with the actual distance between the rows of tubes.

The expandable antivibration bars are hinged together at one end thereof while the free ends are attached to retaining rings around the outside of the tube bundle. The free ends include take-up means to move one half of the split antivibration bar relative to the other half and thereby adjust the overall thickness of the antivibration bar after it has been placed between successive columns of steam generator tubes.

The split halves of the antivibration bars are keyed together along the length thereof to prevent lateral relative motion of the split halves.

In another embodiment, the surfaces of the antivibration bars which support the steam generator tubes are made flexible so that a combination expandable and flexible antivibration bar is provided.

Various other objects, advantages and features of the invention will become apparent to those skilled in the art from the following discussion taken in conjunction with the following drawings, in which:

DESCRIPTION OF THE PREFERRED EMBODIMENTS

Figure 1:
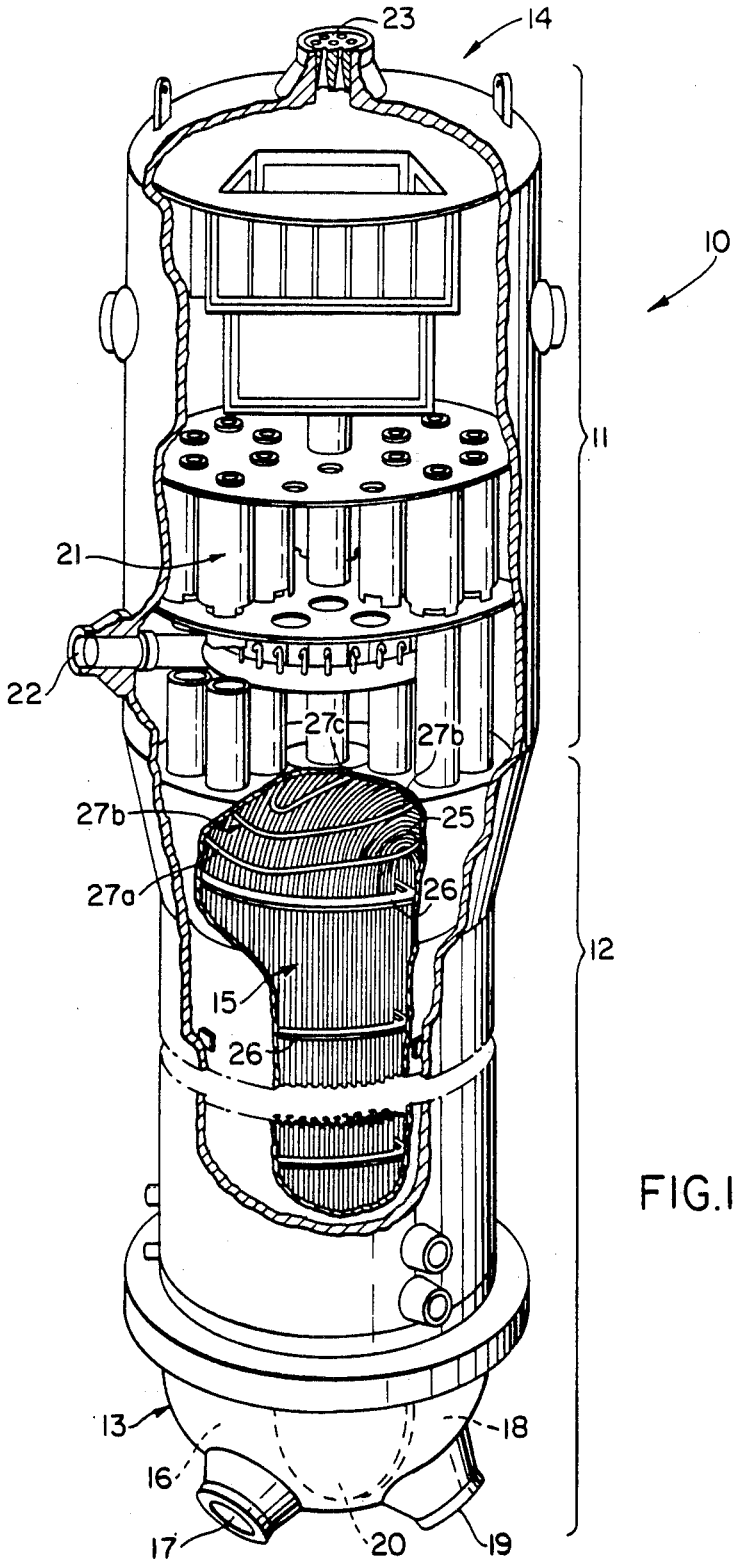
FIG. 1 is a perspective view partially in cross section of a nuclear steam generator having U-shaped bent tubes to which the antivibration apparatus of the present invention may be applied.
Figure 2:
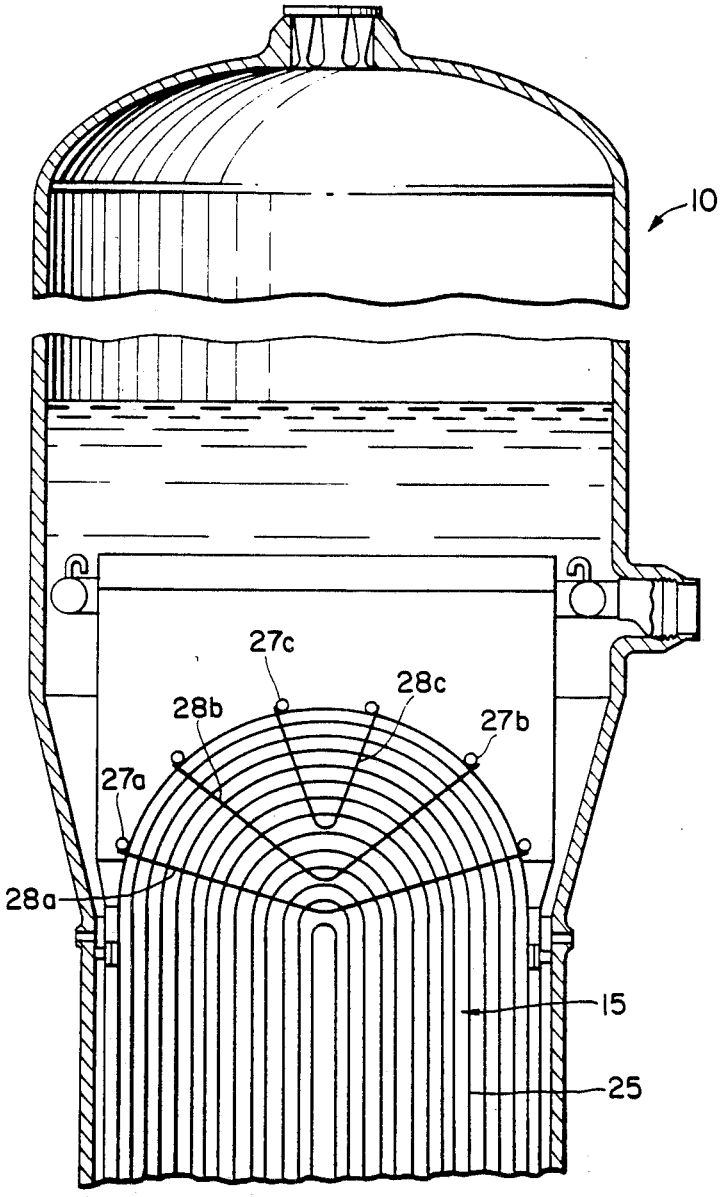
FIG. 2 is a schematic rendering of an axial cross section of the upper portion of the steam generator of FIG. 1, particularly illustrating the bent portion of the flow tubes and the installation position of the antivibration apparatus of the present invention.

Referring now in general to the drawings where like characteristics are referred to by the same reference numerals among the various figures and in particular to FIGS. 1 and 2, which depict a typical steam generator to which the present invention may be applied. To the extent that the steam generator is described and explained in the description of the prior art above, that description and explanation of operation is incorporated in the embodiment shown and described herein by reference as if fully set forth.

Nuclear steam generator 10 comprises a substantially cylindrical shell having upper 11 and lower 12 portions. A semispherical head or channel head 13 is sealingly attached to the lower portion 12; another head is sealingly attached to the upper portion 11. A bundle 15 of U-shaped tubes is disposed within the lower portion 21. One open end of the tube bundle 15 is in flow communication with the hot leg 16 of channel head 13 and a primary coolant flow inlet nozzle 17. The other open end of the tube bundle 15 is in flow communication with the cold leg 18 of channel head 13 and a primary coolant flow outlet nozzle 19. A partition 30 divides the hot 16 and cold 18 legs of the channel head 13. Thus, hot reactor coolant flows into steam generator 10 through inlet nozzle 17 through hot leg 16, into, through, and out of tube bundle 15. The now cooled reactor coolant flows through cold leg 18 and out of outlet nozzle 19 and back to the nuclear reactor to continue the flow cycle.

That portion 12 of the steam generator 10 primarily including the tube bundle 15 and channel head 13 is referred to as the evaporator portion. The upper portion 11 of steam generator 10 is normally referred to as the steam drum portion which includes a moisture separator 21. Feedwater enters the steam generator 10 through an inlet nozzle 22 and mixes with water removed by the moisture separator 21. The feedwater flows down an annular channel surrounding tube bundle 15 and is introduced into tube bundle 15 at the bottom thereof. The mixture of feedwater and recirculating water than flows up through tube bundle 15 where it is heated to a boil by the water flowing within the tubes 25 of tube bundle 15. The steam produced by the boiling feedwater rises up into the steam drum portion 11 where the moisture separator 21 removes water entrained within the steam before the steam exits through a steam outlet nozzle 23. The steam then flows to a steam tubine (not shown) and subsequently back into the steam generator where the cycle is continued.

The U-shaped tubes 25 are supported along their straight lengths in the configuration of the tube bundle 15 by a series of support plates 26. The bent or U-shaped portion of tubes 25 are supported by an assembly comprising retainer rings and antivibration bars. Each of the plurality of retainer rings **27*a*, 27*b* and 27*c* is generally of oval configuration with 27b being smaller than 27*a*, and 27*c* progressively smaller than 27*b*. A plurality of sets of antivibration bars 28 is disposed between adjacent columns of the U-shaped tubes 25. One such set of antivibration bars 28 is more clearly shown in FIG. 2, it being understood that successive sets of similar antivibration bars 28 are disposed behind and in front of the illustrated set. Each of the antivibration bars 28*a*, 28*b*, and 28*c* is of a V-shaped configuration with differing included angles and with the ends thereof attached, such as by welding, to diametrically opposite points of the respective retainer rings 27*a*, 27*b* and 27*c*. FIG. 2 illustrates a cross-sectional schematic view taken through the tube bundle 15 showing that the antivibration bars 28*a*, 28*b* and 28*c* are disposed to support the bent of U-shaped portion of tubes 25, noting the column arrangement of tubes 25. The number of retaining rings 47 and antivibration bars 28 depicted in FIG. 2** is merely for illustration purposes and is not intended to be a limiting consideration.

Figures 3, 4, 5, 6, 7:
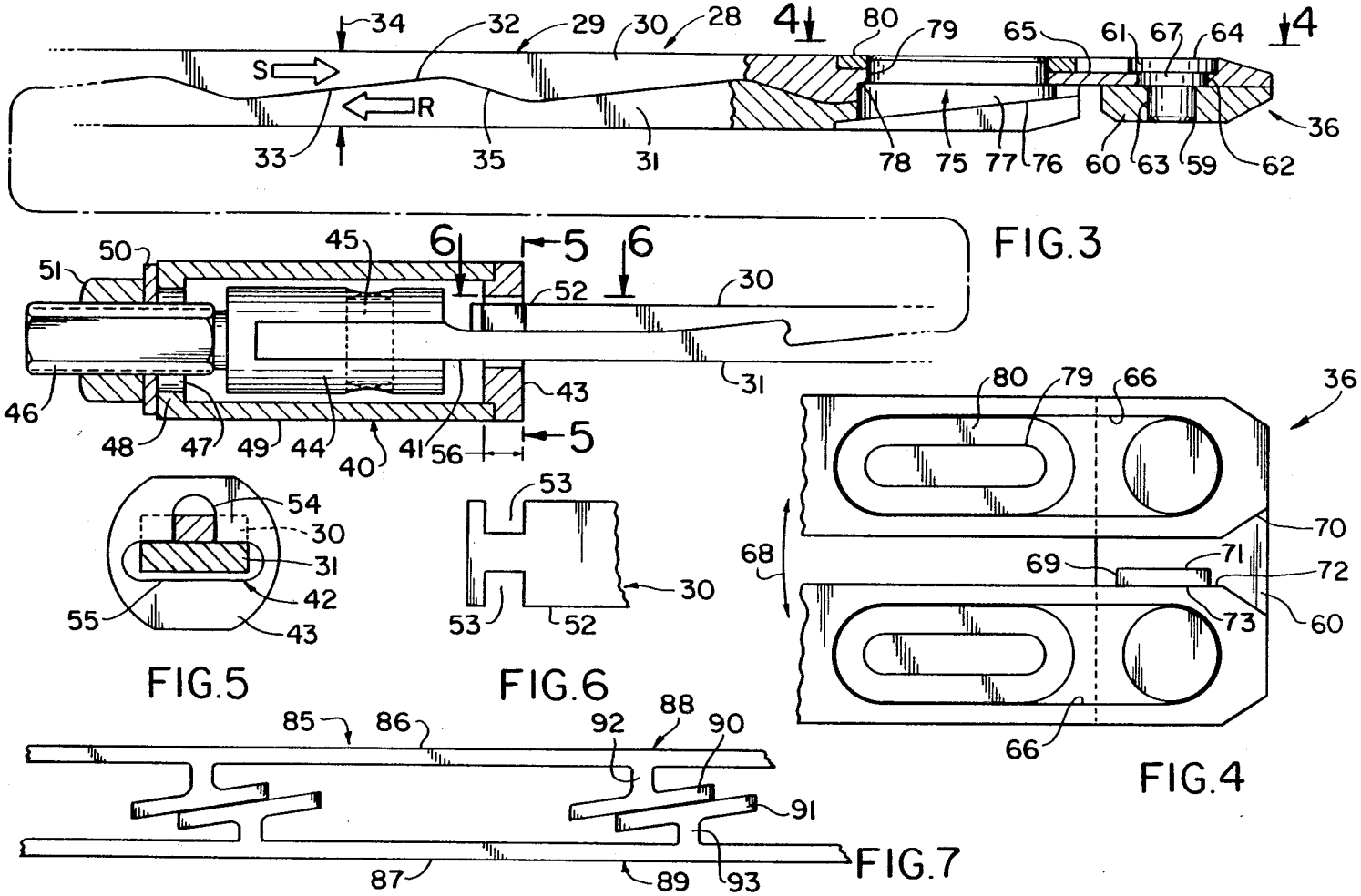
FIG. 3 is a schematic side elevational view partially in cross section of one embodiment of the antivibration bar of the present invention.
FIG. 4 is a view taken along the line 4—4 of the pivoting end of the embodiment of FIG. 3.
FIG. 5 is an end view of the take-up mechanism of the embodiment of FIG. 3, taken along the line 5—5.
FIG. 6 is a top view of the upper half of the antivibration bar taken along the line 6—6 of FIG. 3 illustrating the mechanical attachment to the take-up mechanism; and, FIG. 7 is a partial side elevational view of another embodiment of the antivibration bars of the present invention.

FIG. 3 illustrates one embodiment of the expandable antivibration bar 28 as contemplated by the present invention. Since FIG. 3 is a side elevational view, only one antivibration bar subassembly or leg 29 of antivibration bar 28 is seen. It is to be understood that another leg 29 similar to the one shown, is attached at pivoting end 36. Thus, one antivibration bar 28 is comprised of two legs 29 connected together at ends 26. FIG. 4 shows a plan view of the pivoting connection of the two legs 29 at ends 36.

The operating principle of the expandable antivibration bars 28 is based on relative motion (in the direction of the arrows R and S) between two mating halves 30 and 31, each of which includes linearly connected or successive inclined planes 32 and 33, respectively. When one plane 32 or 33 is moved with respect to the other, the effective height or thickness 34 of leg 29 of antivibration bar 28 changes at a rate proportional to the slope of the inclines 32 and 33. As the slope of inclines 32 and 33 increases, the relative motion, R relative to S, of the halves 30 and 31, to achieve a predetermined increase in thickness 34 decreases. Each half 30 and 31 of leg 29 may be made from a solid bar of stainless steel or other suitable metal. The form of the inclines 32 and 33, specifically the transition 35 between successive inclines, is of a type which may be achieved by an automated numerical control machine which has the advantage of being low cost relative to other machining techniques. In addition, a smooth transition 35 eliminates the stress concentrations of sharper corners thereby permitting higher loads to be applied by the bars 28 to the rows of steam generator tubes. It is to be noted, that one antivibration bar 28 (comprising two legs 29) is required to load a complete row of steam generator tubes. The mechanical advantage derived from the slope of inclines 32 and 33 reduces the required force applied in the direction of the longitudinal axis of legs 29. A very wide range of tradeoffs between thickness 34 increases, force applied, and loading achieved is available with the embodiment of FIG. 3.

Relative motion between the two mating halves 30 and 31 of each leg 29 is generated by a take-up assembly 40. Take-up assembly 40 enables lower bar or half 31 of leg 29 to be moved in a direction of, or opposite to R while maintaining upper bar or half 30 in a fixed position. This relative motion, either increases or decreases the thickness 34 of each leg 29 in accordance with the relative motion between mating inclined planes 32 and 33. End 41 of lower bar 31 passes through opening 42 in end cap 43 and is secured to clevis 44 by pin 45. Threaded stud 46 is attached to the remote end of clevis 44 and extends therefrom through opening 47 and in end cap 48. Cylindrical housing 49 encompasses clevis 44 and is attached to end caps 43 and 48 such as by welding.

Washer 50 and nut 51 engage the end of stud 46 which extends from end cap 48 such that when nut 51 is rotated, washer 50 reacts against cap 48 causing stud 46 to move in a direction to further extend out of cap 48. This, in turn, causes clevis 44 and lower bar 31 to move in the direction of R. Meanwhile, upper bar 30 is retained from moving in any direction because of the manner in which end 52 of upper bar 30 is retained by end cap 43 is further shown in FIGS. 5 and 6. End 52 of upper bar 30 is provided with a slot 53 on each side of bar 30. A "T" shaped section is thus formed at end 52 of upper bar 30. End 52 of bar 30 is placed through opening 42 before bar 31 is inserted through opening 42. When the slots 53 line up with the thickness 56 of end cap 43, upper bar 30 is lifted upward into the vertical portion 54 of opening 42. Then, lower bar 31 is inserted through the horizontal portion 55 of opening 42. Upper bar 30 is lifted upward into the vertical portion 54 of opening 42. Then, lower bar 31 is inserted through the horizontal portion 55 of opening 42. Upper bar 30 is now mechanically captured within end caps 43 because of the physical presence of bar 31 which causes the T shape of upper bar 30 to be engaged by the vertical portion 54 of opening 42. Clevis 44 and pin 45 are. then secured to lower bar 31, and cylindrical portion 49 (including end cap 48) may be welded to end cap 42. The assembly 40 is completed by the attachment of washer 50 and nut 51 to stud 46.

FIG. 4 in conjunction with FIG. 3 illustrates one manner by which the pivoting ends 36 of legs 29 may be pivotally attached to each other. A pivot plate 60 is placed under the lower sides of upper bars 30 at the extremes of ends 36. Pins 61 fit through aligned but stepped openings 62 and 63. Head 64 of pins 61 bear against the surface 65 created by the elongated cutouts 66 in the upper parts of upper bar 30 at end 36. The bottom part of pin 61 may be tack welded 66 to opening 63 to retain pin 61 in position while allowing relative rotation between diameter 67 of pin 61 and opening 62 in bar 30. Each leg 29 may thus be moved in a direction toward or away from each other as indicated by arrows 68. Stop 69, which is a rib protruding up from pivot plate 60, dictates which leg 29 is capable of being moved, and dictates how much each leg 29 is capable of being moved, and thereby fixes the final angular relationship of each leg 29 relative to the other leg 29. As shown in Figure 4, lower leg 29 is prevented from rotating due to the fitup between surface 73 of rib 69 and surface 72 of the lower leg 29 until surface 70 of upper leg 29 meets with surface 71 of rib 39. When this condition occurs, the angular relationship between legs 29 is achieved which is required for proper installation between the columns of a steam generator tube bundle. Such angular relationship is, of course, predetermined for any particular steam generator as well as for the particular location of the antivibration bar 28. Thus, the location shown for rib 39, in FIG. 3, is merely for illustrative purposes. It is preferable that when the antivibration bar 28 is expanded for installation, that there exits no looseness between any of the parts, for example, the pin 61, pivot plate 60 and ends 36 of legs 29. Looseness may result in vibrations which are undesirable. Stop 69 eliminates the possibility of such looseness.

The arrangement of pivotable ends of legs 29 described above is most suitable when the antivibration bars 28 are being used as a replacement for other types of antivibration bars which have been or are being removed from a steam generator which has previously been in operation. In such steam generators, there may be deposits on the tubes of the steam generator and it may be radioactive requiring underwater installation operations. The compact, side-by-side configuration of legs 29 in FIG. 4 presents a small cross section allowing entry through the relatively small openings which are present in an already built steam generator. Then, once in place between the appropriate column of tubes, the legs 29 may be pivoted away from each other to take on the final assembly position and permit attachment to an appropriate retaining ring 27. The takeup assemblies 40 may then be actuated to expand the split halves 30 and 31 of the antivibration bar 28 to eliminate any gap between the antivibration bar 28 and the tubes 25 of the steam generator 10.

End 36 of legs 29 may alternatively be arranged about a single hinge pin (not shown). In this arrangement, it will be noted that a slightly larger overall cross section is required because a single pin does not allow for side-by-side positioning of legs 29. The final relationship of each leg 29 relative to the other leg 29 will again be determined by a positive stop or rib and when assembled to the retaining rings 27. Still another alternative is the permanent fixing of each end 36 of legs 29 to each other such as by welding or by other mechanical means (not shown). These latter two arrangements are more suitable to a steam generator in the process of being built, where space is not a problem, rather than one that has already been built and is in service.

Referring again to FIGS. 3 and 4, ends 26 of upper 30 and lower 31 bars of each leg 29 are fitted with a key-keyway arrangement 75 which allows for relative movement between the upper 30 and lower 31 bars of the antivibration bars 28 in a direction along the longitudinal axis of the bars. This motion is, of course, necessary in order to adjust the thickness 34 of antivibration bars 18 to completely take up the space between the columns of steam generator tubes 15. An inclined surface 76, consistent with the slope of inclines 32 and 33, may be used with key 77 in order to allow key 77 to move and thereby stay in position relative to the contacting surfaces of bars 30 and 31 when thickness 34 is adjusted. This arrangement assures that key 77 remains engaged with both the upper 30 and lower 31 bars. Key 77 is secured to upper bar 30 in accordance with stop 78 of key 77, opening 79 in upper bar 30 and retaining bar 80 which is welded to key 77 at stop 78.

FIG. 7 illustrates an antivibration bar 85 of the present expandable invention in combination with flexible support members 86 and 87. This variation allows for differences in the individual location of steam generator tubes and for movement of an entire column of steam generator tubes. Flexible support 86 is associated with and comprises the main structure of upper bar 88; while, flexible support 87 is associated with and comprises the main structure of lower bar 89. Bars 88 and 89 may move relative to each other, similar to the embodiment in FIG. 3, in accordance with co-acting, inclined members 90 and 91. Ribs 92 and 93 structurally connect inclines 90 and 91 to bars 88 and 89, respectively. Connecting ribs 92 and 93 are observed to be relatively thin compared to the length of inclined members 90 and 91. This arrangement provides for the advantage associated with full length inclined members while minimizing the interference caused by ribs 92 and 93 with the flexibility of supporting members 86 and 87. The unshown ends of bars 88 and 89 may be, of course, provided with the take-up assemblies shown in FIG. 3 and the pivoting plate and pivot pins also shown in FIG. 3. In usage, the embodiment of FIG. 7 is arranged such that ribs 92 and 93 are staggered or offset relative to the ribs 92 and 93 of the antivibration bar 85 within the adjacent column of tubes.

In accordance with the above, new and unique antivibration bars are disclosed for use with steam generators which are either being newly built or have been previously built and operated.

While the invention has been described, disclosed, illustrated and shown in certain terms or certain embodiments or modifications which it has assumed in practice, the scope of the invention is not intended to be nor should it be deemed to be limited thereby and such other modifications or embodiments as may be suggested by the teachings herein are particularly reserved especially as they fall within the breadth and scope of the claims here appended.

I claim as my invention:

1. In a steam generator for a nuclear power plant comprising a shell, a plurality of tubes having a U-shaped configuration arranged in successive columns within said shell, said tubes being adapted to heat feedwater flowing around the outside of said tubes by the flow of hot reactor coolant within said tubes, and antivibration bars any vibrations of said tubes as a result of steam between said columns of tubes, the improvement comprising means for varying the thickness of said antivibration bars to fit substantially the actual space between said columns of tubes comprising first and second bars, with at least one bar being movable, and with at least one mating inclined surface between said first and second bars.

2. The apparatus of claim 1, further including retaining ring means arranged around the outer periphery of said plurality of tubes at the U-shaped portion of said tubes said antivibration bars fitting between said successive columns of said tubes being attached at their ends to said retainer ring means.

3. The apparatus of claim 2, wherein said expandable antivibration bars comprise first and second elongated bar assemblies with each assembly comprising an upper elongated bar and a lower elongated bar with at least one mating inclined surface interposed therebetween and arranged such that relative motion between said upper and lower bars in the direction of the longitudinal axis of said bars causes an increase or decrease in the combined thickness of said bars in accordance with the amount of said relative motion.

4. The apparatus of claim 2, wherein said expandable antivibration bars comprise first and second elongated bar assemblies with each assembly comprising an upper and a lower elongated bar in contact with each other along longitudinal surfaces thereof with each bar having a plurality of successive inclined planes formed in said surface in contact with the other elongated bar, said contacting surfaces cooperating with each other such that relative longitudinal motion between said upper and lower bars causes an increase or a decrease in the combined thickness of said bars in accordance with the slope of said planes and the amount of said relative motion.

5. A steam generator for a nuclear power plant comprising a shell, a plurality of tubes having a U-shaped configuration arranged in successive columns within said shell, said tubes being adapted to heat feedwater flowing around the outside of said tubes by the flow of hot reactor coolant within said tubes, expandable antivibration means comprising retaining ring means arranged around the outer periphery of said plurality of tubes at the U-shaped portions of said tubes, expandable antivibration bars fitting between said successive columns of tubes and being attached at their ends to said retainer ring means, said antivibration bars comprising first and second elongated bar assemblies, each assembly comprising an uppper elongated bar and a lower elongated bar with at least one mating inclined surface interposed therebetween and arranged such that relative motion between said upper and lower bars in the direction of the longitudinal axis of said bars causes an increase or decrease in the combined thickness of said bars in accordance with the amount of said relative motion.

6. The apparatus of claim 5 wherein said first and second elongated bar assemblies are joined together at one end forming a predetermined angle therebetween.

7. The apparatus of claim 5, wherein said first and second elongated bar assemblies are pivotally joined together at one end.

8. The apparatus of claim 5, wherein said expandable antivibration means comprises means for pivotally connecting an end of each of said elongated bar assemblies and for arranging said elongated assemblies in a side-by-side array.

9. The apparatus of claim 8, wherein said means for pivotally connecting an end of each of said elongated bar assemblies and for arranging said elongated bar assemblies in a side-by-side array comprises a pivot plate located at said end of said elongated bar assemblies and a pair of pivot pins each pivotally connecting one of said elongated bar assemblies tb said pivot plate.

10. A steam generator for a nuclear power plant comprising a shell, a plurality of tubes having a U-shaped configuration arranged in successive columns within said shell, said tubes being adapted to heat feedwater flowing around the outside of said tubes by the flow of hot reactor coolant within said tubes, expandable antivibration means comprising retaining ring means arranged around the outer periphery of said plurality of tubes at the U-shaped portions of said tubes, expandable antivibration bars fitting between said successive columns of tubes and being attached at their ends to said retainer ring means, said antivibration bars comprising first and second elongated bar assemblies, each assembly comprising an upper elongated bar and a lower elongated bar in contact with each other along longitudinal surfaces thereof with each bar having a plurality of successive inclined planes formed in said surface in contact with the other elongated bar, said contacting surfaces cooperating with each other such that relative longitudinal motion between said upper and lower bars causes an increase or a decrease in the combined thickness of said bars in accordance with the slope of said planes and the amount of said relative motion.

11. The apparatus of claim 10, wherein said expandable antivibration bars comprise a key-keyway arrangement between said upper and lower bars whereby said bars are able to move only in a relative longitudinal direction.

12. The apparatus of claim 10, wherein said expandable antivibration bars comprise means for moving each of said lower bars relative to said upper bars.

13. The apparatus of claim 12, wherein said means for moving said lower bars relative to said upper bars comprises a threaded member attached to one of said upper or lower bars at the end thereof, a nut threadingly engaged on said threaded member, a plate member attached to the other of said upper or lower bars at an end thereof with an opening therethrough, said threaded member fitting through said opening, and said nut bearing against a side of said plate member, and whereby rotation of said nut causes relative motion between said upper and lower bars.

* * * * *